US008474206B2

(12) United States Patent
Favell

(10) Patent No.: US 8,474,206 B2
(45) Date of Patent: Jul. 2, 2013

(54) POST AND A STRUCTURE COMPRISING A POST

(75) Inventor: Giles Favell, London (GB)

(73) Assignee: Steeldeck Industries Limited (GB)

( * ) Notice: Subject to any disclaimer, the term of this patent is extended or adjusted under 35 U.S.C. 154(b) by 0 days.

(21) Appl. No.: 12/676,660

(22) PCT Filed: Sep. 5, 2008

(86) PCT No.: PCT/GB2008/003009
§ 371 (c)(1),
(2), (4) Date: Apr. 23, 2010

(87) PCT Pub. No.: WO2009/030920
PCT Pub. Date: Mar. 12, 2009

(65) Prior Publication Data

US 2010/0300039 A1 Dec. 2, 2010

(30) Foreign Application Priority Data

Sep. 5, 2007 (GB) ..... 0717255.4

(51) Int. Cl.
*E02D 27/42* (2006.01)

(52) U.S. Cl.
USPC ..... 52/298; 52/170; 52/706; 256/65.14; 403/109.5; 403/374.4

(58) Field of Classification Search
USPC ..... 52/170, 298, 704, 706; 403/374.3, 403/374.4, 109.5; 256/65.14
See application file for complete search history.

(56) References Cited

U.S. PATENT DOCUMENTS 2,954,638 A 10/1960 Motter ..... 45/137
3,421,726 A * 1/1969 Getter ..... 410/110

(Continued)

FOREIGN PATENT DOCUMENTS

FR 2 256 996 A 8/1975
FR 2 588 894 4/1987

(Continued)

OTHER PUBLICATIONS

International Search Report dated Feb. 10, 2009, issued in corresponding international application No. PCT/GB2008/003009.

(Continued)

*Primary Examiner* — Brian Glessner
*Assistant Examiner* — Brian D Mattei
(74) *Attorney, Agent, or Firm* — Ostrolenk Faber LLP

(57) ABSTRACT

The present disclosure resides in a post, configured to be removably securable in an aperture and having a predetermined first cross-sectional area. The post includes an end portion having an angled face and a wedge, having a complementary angled face arranged against the angled face of the end portion. The wedge is configured to be slidably movable at the end portion to adjust a second cross-sectional area, defined by the wedge and the end portion. The angled face of the wedge is slidably movable relative to the angled face of the end portion to increase the second cross-sectional area relative to the first cross-sectional area to tightly secure the end portion (14) within an aperture. The post may further comprise a mechanism connected to the wedge for slidably moving the angled face of the wedge relative to the angled face of the end portion to increase the second cross-sectional area relative to the first cross-sectional area to tightly secure the end portion within an aperture. The mechanism may be a drawbar having a threaded portion, which is engageable with the wedge whereby rotation of the drawbar causes the wedge to slidably move.

11 Claims, 2 Drawing Sheets

U.S. PATENT DOCUMENTS

| | | | | | |
|---|---|---|---|---|---|
| 3,579,936 | A | | 5/1971 | Andersson et al. | 52/726 |
| 3,841,695 | A | * | 10/1974 | Woodward | 296/43 |
| 4,059,934 | A | | 11/1977 | Hayamizu | |
| 4,095,911 | A | * | 6/1978 | Lacroix | 403/104 |
| 4,274,301 | A | * | 6/1981 | Katayama | 74/551.1 |
| 4,850,733 | A | | 7/1989 | Shook | 403/104 |
| 5,022,134 | A | | 6/1991 | George | |
| 5,251,494 | A | | 10/1993 | Edwards | 74/551.1 |
| 5,680,798 | A | * | 10/1997 | Luen | 74/551.1 |
| 5,975,500 | A | | 11/1999 | Orton et al. | |
| 6,457,895 | B1 | | 10/2002 | Salman | 403/2 |
| 6,749,383 | B1 | | 6/2004 | Benedict et al. | 410/153 |
| 7,055,807 | B2 | * | 6/2006 | Pesta | 256/65.14 |
| 2005/0116212 | A1 | * | 6/2005 | Deeley | 256/22 |
| 2006/0255215 | A1 | * | 11/2006 | Carnevali | 248/125.8 |

FOREIGN PATENT DOCUMENTS

| | | | |
|---|---|---|---|
| FR | 2 863 294 | | 6/2005 |
| GB | 390 701 | A | 4/1933 |
| JP | 55084330 | U | 6/1955 |
| JP | 57040111 | A | 3/1982 |
| JP | 04-113011 | A | 4/1992 |
| JP | 9-209457 | | 8/1997 |
| JP | 11-210719 | | 8/1999 |

OTHER PUBLICATIONS

Notification Concerning Transmittal of International Preliminary Report on Patentability, International Preliminary Report on Patentability, and Written Opinion of the International Searching Authority issued Mar. 9, 2010 in corresponding International Application PCT/GB/2008/003009, 8 pages total.

Search Report issued Sep. 5, 2008 in corresponding United Kingdom Application No. GB 0717255.4.

Japanese Office Action dated Oct. 15, 2012 with an English translation.

* cited by examiner

POST AND A STRUCTURE COMPRISING A POST

CROSS REFERENCE TO RELATED APPLICATIONS

The present application is a 35 U.S.C. §371 National Phase conversion of PCT/GB2008/003009, filed Sep. 5, 2008, which claims benefit of British Application No. 0717255.4, filed Sep. 5, 2007, the disclosure of which is incorporated herein by reference. The PCT International Application was published in the English language.

BACKGROUND OF THE INVENTION

This invention relates to a post and particularly, but not exclusively, to an individual post or a post that forms part of a fence, barrier or similar structural feature in which the post is located in an aperture and secured therein.

Means of securing posts and barriers for use in temporary installations are known which disclose a socket provided with a wedge arrangement that compresses against a localised point on the outer surface of a post located therein to secure the post in place. However, in U.S. Pat. No. 4,059,934 for example, the aperture in which the post is located must comprise a means for securing the post therein. The mechanisms associated with securing the posts are either obtrusive and/or visible when in use, thus being unattractive to look at while being susceptible to contamination from dirt and grime and the like. Nowadays, posts and barriers used in architectural installations must not only be practical to use but also be aesthetic in appearance.

Further, JP4113011 discloses a wedge configured to force apart the sides of a hollow post within a socket such that the diameter of the post is increased at that point and a force is applied, in a localised area of the socket and jams the post in the socket. Because the increase of diameter takes place only at the extreme end of the post, the system requires a second fix of retaining screws in order to impart rigidity to the post. This detail requires internal access to the post, and is in no way appropriate for a removable detail.

SUMMARY OF THE INVENTION

It is against this background that the present invention has been made. This invention results from efforts to overcome the problems of known apparatus used to secure a post within an aperture. Other aims of the invention will be apparent from the following description.

Accordingly, the invention resides in a post, configured to be removably securable in an aperture and having a predetermined first cross-sectional area, the post having an end portion having an angled face; and a wedge, having a complementary angled face arranged against the angled face of the end portion, which is configured to be slidably movable at the end portion to adjust a second cross-sectional area, defined by the wedge and the end portion, wherein the angled face of the wedge is slidably movable relative to the angled face of the end portion to increase the second cross-sectional area relative to the first cross-sectional area to tightly secure the end portion within an aperture.

The aperture may take the form of a socket, recess or may be defined by a space between two fixed objects. In practice, the dimensions of the aperture closely match those of the post so that there is minimal movement after the post has been inserted and before the post has been secured in the aperture.

In use, the post is inserted into a socket when the second cross-sectional area, defined by the wedge and the end portion, is less than or equal to the cross-sectional area of the post. In effect, the shape of the end portion is contracted to allow a user to more easily insert the end portion of the post into the aperture. Thereafter, the wedge is slid along the angled face of the end portion, effectively expanding the wedge within the socket by extending the wedge beyond the surface of the post; thus the second cross-sectional area is increased relative to the first cross-sectional area. By forcing the wedge laterally outwards all shake and play is removed from the post, giving a good solid feel to the assembly.

In practice, the post may further comprise a mechanism connected to the wedge for slidably moving the angled face of the wedge relative to the angled face of the end portion to increase the second cross-sectional area relative to the first cross-sectional area to tightly secure the end portion within an aperture. The mechanism may take the form of a drawbar and the drawbar may have a threaded portion thereon to engage with the wedge. A rotation of the drawbar causes the wedge to slidably move. The position of the wedge may alternatively be controllable via a cantilever mechanism using similar principles to those used on quick-release hubs of bicycles. The drawbar may extend to a distal end of the post remote the end portion or alternatively be accessed via an adjustment point located on the side of the post, the adjustment of the mechanism being implemented by a worm gear or similar arrangement.

As the position of the wedge is adjusted, an exterior surface, or interface surface of the wedge may maintain a substantially parallel relationship with the longitudinal axis of the post. The parallel movement of the interface surface results in a force being applied to the internal surface of the socket along the entire length of the interface surface of the wedge. By doing so, this prevents a localised point-force being applied to the socket that could result in damage to the socket or an unsafely secured post.

The post may have a square, circular, rectangular, hexagonal or polygonal cross-sectional profile.

The post may form an integral part of a barrier, seating structure, signage, furniture or a fence. The post will more usually form a limb of such structures and the application of the wedge located on the angled face of the end portion of the post, or limb, is not limited to a single post and can be used in any number of structures in which a post, or a limb is to be inserted and secured in a socket or other aperture. The post in this invention may comprise only the lower part thereof, with any form of post, barrier or limb attached to it.

The invention also resides in a barrier comprising at least two above-mentioned posts and having at least one cross-member extending between the posts to form the barrier. The posts, or limbs, may extend from seating structures, display signs, fencing applications or any such object that is to be secured within a socket or other aperture in a solid manner.

BRIEF DESCRIPTION OF THE DRAWINGS

In order that the invention may be more readily understood, reference will now be made, by way of example, to the drawings in which.

DESCRIPTION OF PREFERRED EMBODIMENTS

Figure 1:
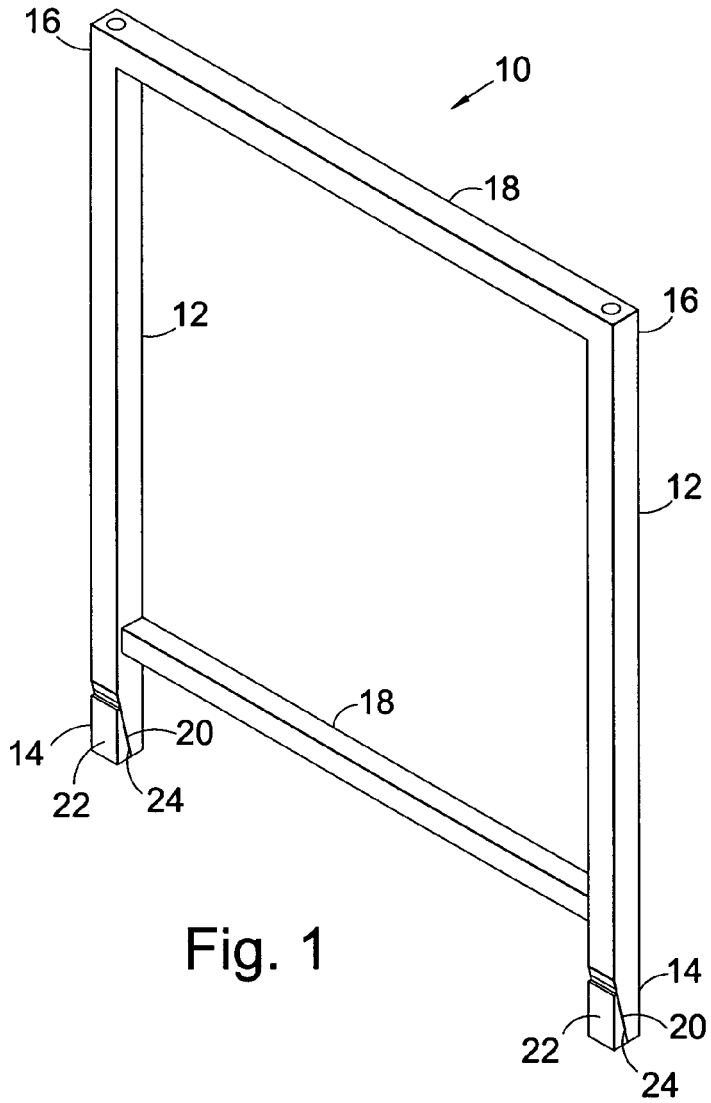
FIG. 1 is a perspective view of a barrier of the invention having two posts, each post having an end portion that includes a wedge.

Referring to FIG. 1 of the drawings, a barrier 10 includes two posts 12, each post 12 having an end portion 14 and a distal end 16. Crossbars 18 extend between the posts 12 to form the barrier structure 10. Each end portion 14 comprises an angled face 20 and a wedge 22 having a complementary angled face 24 arranged against the angled face 20 of the end portion 14. The end portion of each post 12 is inserted, in use, into a corresponding socket or other aperture (not shown) thus locating the end portion 14 therein.

The barrier 10 may be fabricated from square-section mild steel tube and the barrier may take any shape, or have any number of cross-pieces depending on its application. A barrier may comprise a single post 12, a pair of posts (as shown in FIG. 1) or any multiple of posts 12. At least one of the posts 12 will comprise an angled face 20 and a wedge portion 22 located thereagainst.

Figure 2:
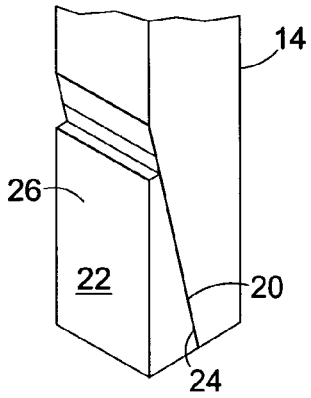
FIG. 2 is a perspective view of an end portion of the post of FIG. 1, wherein the wedge is shown in a first position with respect to the end portion.

In a first position, as shown in FIG. 2, the end portion of the post 12 has a wedge 22 located against the angled face 20 of the end portion 14. In the first position, an interface (exterior) surface 26 of the wedge is positioned to be flush with the interface surface of the post 12 and the cross-sectional area across the wedge and end portion is equal to the cross-sectional area of the main body of the post 12.

Figure 3:
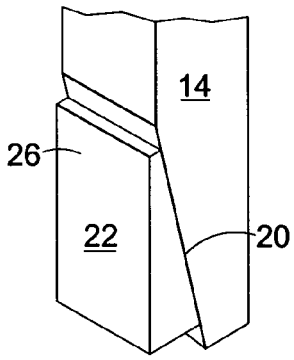
FIG. 3 is a perspective view of an end portion of the post of FIG. 1, wherein the wedge is shown in a second position with respect to the end portion.

In a second position, as shown in FIG. 3, the wedge 22 is moved towards the distal end 16 of the post 12, along the angled face 20 of the end portion 14, such that the interface surface 26 of the wedge extends beyond the surface of the post 12. In the second position, the cross-sectional area defined by the wedge 22 located against the end portion 14 is greater than the cross-sectional area of the post 12. In the second position the interface surface of the wedge can be forced against the interior surface of an aperture (usually a socket) and thus secure the post 12 in place.

Figure 4:
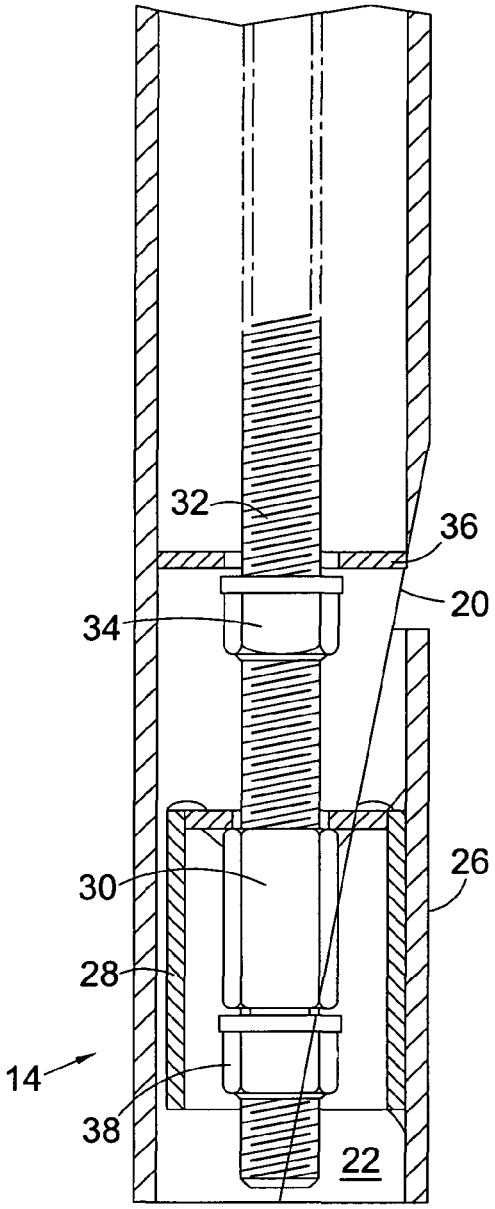
FIG. 4 is a cross-section view of the end portion of the shown in FIG. 2.

FIG. 4 is a cross-section view taken through the end portion of the post 12 when the wedge 22 is in a first position. The wedge includes a wedge frame 28, the wedge frame being connected to an adjustment-nut 30 that is threadably engaged with a mechanism in the form of a drawbar 32, which passes through the adjustment nut 30.

The drawbar 32 is located centrally within the post 12 but is able to move laterally, and may bend slightly as the wedge 22 is drawn up. A stop nut 38 is provided at the end of the drawbar 32 to prevent the adjustment-nut 30 coming off the drawbar 32, and a stop nut 34 is provided to enable the drawbar 32 to push the wedge down in order to release the mechanism.

The wedge frame 28 is connected upon the adjustment-nut 30 so that, in use, rotation of the drawbar 32 serves to move the adjustment-nut, which in turn moves the wedge 22 along the angled face 20 of the end portion 14. As the wedge moves along the angled face of the end portion, the interface surface 26 maintains a substantially parallel relationship with the drawbar 32.

In use, the end portion 14 would be inserted into an aperture (not shown) and locate therein. A user would then rotate the drawbar 32 to draw the adjustment-nut 30 towards the cross piece 36, whose hole is slotted or over size to allow the drawbar to move laterally, enabling the wedge 22 to move out, increasing the second cross-sectional area. The wedge frame 28 is connected to the adjustment-nut 30. Alternatively, the wedge frame 28 is connected to the adjustment-nut 30 such that the wedge frame 28 and the wedge 22 can move laterally with respect to the drawbar 32.

Figure 5:
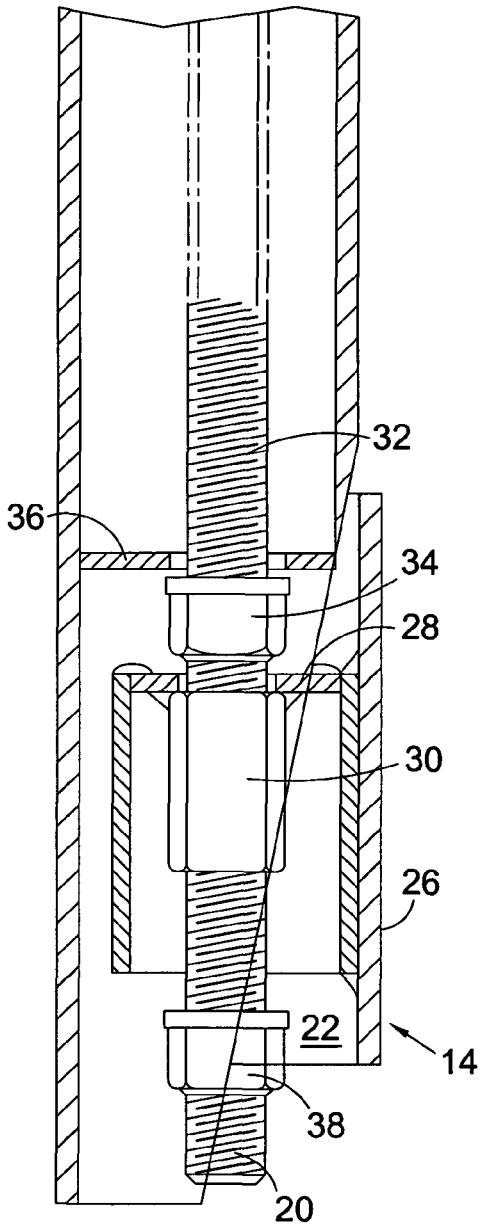
FIG. 5 is a cross-section view of the end portion of the post shown in FIG. 3.

After a number of rotations of the draw-bar 32, the adjustment-nut 30 moves towards the cross piece 36 until the wedge 22 is in a second position corresponding to FIG. 2 and shown by the cross-section in FIG. 5. As the wedge 22 moved along the angled face 20 of the end portion, the lateral adjustment of the wedge frame 28 upon the adjustment-nut 30 enables the interface surface 26 of the wedge 22 to remain substantially parallel with respect to the drawbar 32 or central axis of the post 12. In the second position, the lateral movement of the interface surface 26 of the wedge applies a lateral force, via the adjustment-nut 30 and wedge frame 28, to the side of the aperture in which the end portion 14 is located. As a result, the end portion 14 is secured within the aperture (not shown).

Although not shown, the drawbar 32 extends to a distal end 16 of the post 12 where an interface is provided to enable a user to rotate the drawbar 32. The interface may comprise a manual user interface, such as a wing-nut, or alternatively may comprise an interface suitable for engaging with a tool. By way of example, the interface may comprise a hexagonal head for interface with a socket, spanner or Allen-key.

Used singularly, in pairs or in multiples, the end portion of the invention allows quick and easy fitting and removal of posts, rails or pedestals etc. By drawing the wedge against the angled face of the end portion via a drawbar, a firm and strong fixing into cheap and simple sockets is provided. The sockets required for such an invention are simple and can be cast into concrete or formed of steel and bolted or welded to any form of structure.

For applications in which the posts form part of a barrier, a square cross-sectional post and corresponding square socket should be used. Where rotational adjustment of a post is required, a round post should be used in a corresponding round socket to allow angular adjustment in the socket. Although the Figures show that the post is square in cross-sectional profile, the shape of the post and its corresponding aperture can be rectangular, hexagonal, polygonal or of any shape, to either control the alignment of the post or to choose the orientation of the post within the aperture as desired.

The post of the invention is not limited to being secured in a socket or other aperture but can also be used between fixed planes defined by two adjacent objects.

The post of the invention is particularly advantageous when a square-shaped post is secured in a circular aperture. In the secured position the four corners of the post engage with the aperture such that there is substantially no free movement, or play, in a direction substantially perpendicular to the post. Where the post forms part of a structure having more than one post, and said structure is located in more than one aperture, then at least one of the posts is preferably square, and is secured in a corresponding square aperture because such an arrangement provides movement, or play, in at least one direction which is substantially perpendicular to the post, this allowing minor adjustment to be made to the position of the installed structure.

In addition to the force of the interface surface being applied against the internal surface of an aperture, a lip, pin or barb may be configured upon the interface surface and/or the end portion to inhibit removal of the post in safety critical applications thus preventing the post being accidentally pulled out.

The post may be made of any suitable material but is preferably formed from laser-cut mild steel to reduce costs.

Although the application is demonstrated by way of example using a barrier, the post of the invention, comprising an adjustable end portion, or limb, is applicable for use in seating structures, display signs, fencing applications and the like.

The post can be applied to fittings in floors, walls and ceilings and can be applied indoors or outdoors, to buildings, to boats, to aeroplanes or to vehicles or vehicle trailers.

The post of the invention provides the ability to have removable sections of structure or architectural furniture, without the necessity of having obtrusive visible fixings.

What is claimed is:

1. A post, configured to be removably securable in an aperture and having a predetermined first cross-sectional area, the post having:

an end portion having an angled face; and a wedge, having a complementary angled face arranged against the angled face of the end portion, which is configured to be slidably movable at the end portion to adjust a second cross-sectional area, defined by the wedge and the end portion, wherein the angled face of the wedge is slidably movable relative to the angled face of the end portion to increase the second cross-sectional area relative to the first cross-sectional area to tightly secure the end portion within an aperture;

a mechanism connected to the wedge for slidably moving the angled face of the wedge relative to the angled face of the end portion to increase the second cross-sectional area relative to the first cross-sectional area to tightly secure the end portion within an aperture, wherein the mechanism includes a drawbar which extends from a first part located at the end portion of the post to a second part at a distal end of the post, the distal end being opposite the end portion and remote from the end portion, the drawbar having a threaded portion at the first part, the threaded portion being engageable with the wedge, whereby the rotation of the drawbar causes the wedge to slidably move, wherein the wedge is movable to a position where the second cross-sectional area is smaller than the first cross-sectional area, the drawbar has a longitudinal axis and the wedge is moveable to a position where the angled face of the wedge overlaps the surface of the drawbar when seen in cross-section in a plane which includes the longitudinal axis of the drawbar and a line that is normal to the angled face of the wedge.

2. The post as claimed in claim 1, wherein an exterior surface of the wedge maintains a substantially parallel relationship with the longitudinal axis of the post.

3. The post as claimed in claim 1, wherein the cross-sectional profile of the post is circular.

4. The post as claimed in claim 1, wherein the cross-sectional profile of the post is square.

5. The post as claimed in claim 1, wherein the post is an integral part of one of a barrier, seating structure, signage, furniture or a fence.

6. A barrier comprising at least two posts according to claim 1 and having at least one cross-member extending between the posts.

7. The post as claimed in claim 1, wherein the mechanism is a drawbar having a stop nut engaged with the drawbar, configured to push the wedge down in order to release the wedge.

8. The post as claimed in claim 1, further comprising an interface provided at the distal end to enable a user to rotate said drawbar.

9. The post as claimed in claim 8, wherein the interface is a manual user interface.

10. The post as claimed in claim 8, wherein the interface is suitable for engaging with a tool.

11. A post, configured to be removably securable in an aperture and having a predetermined first cross-sectional area, the post having:

an end portion having an angled face; and a wedge, having a complementary angled face arranged against the angled face of the end portion, which is configured to be slidably movable at the end portion to adjust a second cross-sectional area, defined by the wedge and the end portion, wherein the angled face of the wedge is slidably movable relative to the angled face of the end portion to increase the second cross-sectional area relative to the first cross-sectional area to tightly secure the end portion within an aperture;

a mechanism connected to the wedge for slidably moving the angled face of the wedge relative to the angled face of the end portion to increase the second cross-sectional area relative to the first cross-sectional area to tightly secure the end portion within an aperture, wherein the mechanism includes a drawbar which extends from a first part located at the end portion of the post to a second part at a distal end of the post, the distal end being opposite the end portion and remote from the end portion, the drawbar having a threaded portion at the first part, the threaded portion being engageable with the wedge, whereby the rotation of the drawbar causes the wedge to slidably move, and wherein the wedge includes a wedge frame, the wedge frame being connected to an adjustment-nut and the mechanism is a drawbar having a threaded portion engageable with the adjustment nut, the wedge frame being connected to the adjustment-nut such that the wedge frame and the wedge can move laterally with respect to the drawbar.

* * * * *